United States Patent [19]

Tipton

[11] 4,314,536

[45] Feb. 9, 1982

[54] PULSING SOLENOID IMPROVEMENT

[75] Inventor: Larry J. Tipton, Florissant, Mo.

[73] Assignee: ACF Industries, Inc., New York, N.Y.

[21] Appl. No.: 108,483

[22] Filed: Dec. 31, 1979

[51] Int. Cl.[3] ..... F02M 7/00; F02M 23/00

[52] U.S. Cl. ..... 123/440; 123/589; 261/121 B; 137/625.48

[58] Field of Search ..... 123/585, 589, 440, 327; 261/121 B; 137/625.48; 251/141

[56] References Cited

U.S. PATENT DOCUMENTS

| | | | |
|---|---|---|---|
| 4,132,199 | 6/1979 | Kuruiwa et al. | 261/121 B |
| 4,181,108 | 1/1980 | Bellicardi | 261/121 B |
| 4,254,754 | 4/1981 | Takada et al. | 137/625.48 |

*Primary Examiner*—Charles J. Myhre
*Assistant Examiner*—E. Rollins Cross
*Attorney, Agent, or Firm*—J. Joseph Muller

[57] ABSTRACT

A control system improvement. A high speed air bleed path and a low speed air bleed path respectively bleed air into the high speed and low speed fuel circuits of a carburetor through either fuel circuit at any one time. A solenoid responsive to a control signal opens and closes the air bleed to control the quantity of air bled into the high speed and low speed circuits. The solenoid includes an isolator for isolating the high speed air bleed path from the low speed air bleed path to prevent cross flow of air from one air bleed path to the other. Cross flow of air between the paths adversely affects the degree of control over the delivery of fuel through the high speed and low speed fuel circuits.

2 Claims, 7 Drawing Figures

FIG. 1
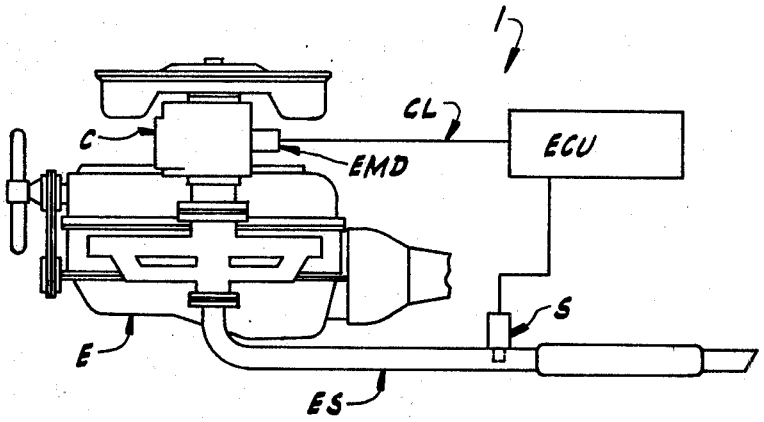
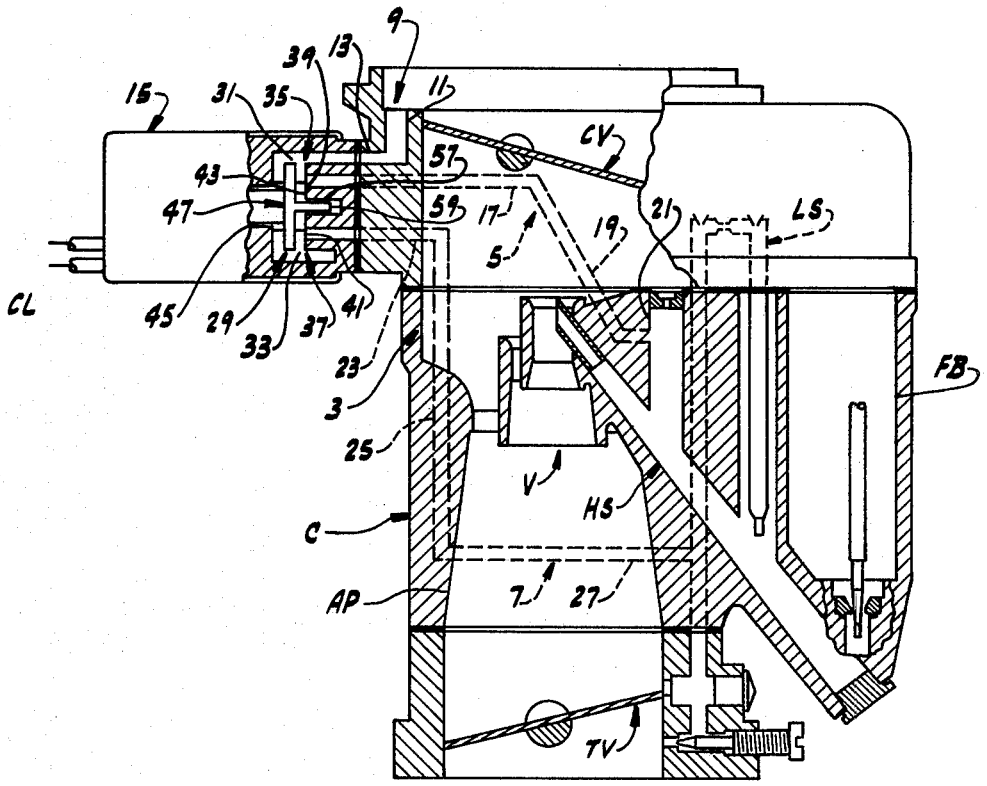
FIG. 2

PULSING SOLENOID IMPROVEMENT

BACKGROUND OF THE INVENTION

This invention relates fuel control systems for automobile engines and more particularly to an improvement in a solenoid used in such a system.

With the need to control automobile engine operations so to improve fuel economy, reduce emissions and still achieve good driveability, various schemes have been developed to control the air-to-fuel ratio of the mixture produced in a carburetor and supplied to an engine. Many such schemes use an auxiliary air bleed to vary the pressure in a fuel circuit of the carburetor. By controlling the quantity of auxiliary air bled into a fuel circuit the quantity of fuel supplied to a air passage of the carburetor can be controlled and hence the ratio of the resultant mixture. Control of the air bleed has typically been accomplished using a pulsed solenoid.

Since most carburetors utilize two separate fuel circuits; one for high speed engine operation and the other for low or idle speed operation, systems previously employed have used two separate solenoids, each controlling an air bleed to each separate fuel circuit. This is because the two fuel circuits are subjected to vastly different vacuum signals; the high speed circuit being subjected to a signal measured in inches of water ($H_2O$) and the low speed circuit being subjected to a signal measured in inches of mercury (Hq). Were one solenoid used to control air bleed to both systems, the idle speed circuit would create a slight depression in the air bleed path for the high speed circuit and the resultant air-fuel mixture produced with the high speed circuit would be richer than it should be. At the same time however, the capability of using only one solenoid to control both bleeds would produce economies of cost, simplify circuitry and overall reduce system complexity.

SUMMARY OF THE INVENTION

Among the objects of the present invention may be noted the improvement in a pulsing solenoid used in a fuel control system for an internal combustion engine; the provision of such an improvement which permits a single solenoid to control the respective air bleed paths to both the high and low speed fuel circuits of a carburetor, the provision of such an improvement which permits such control without one air bleed path interfering with the other air bleed path; and the provision of such an improvement for simplifying the overall design of the control system.

Basically, the improvement of the present invention comprises air bleed means defining a high speed air bleed path and a low speed air bleed path for respectively bleeding air into the high speed and low speed fuel circuits of a carburetor. This varies the quantity of fuel delivered to an air passage of the carburetor through either fuel circuit at any one time. A solenoid responsive to a control signal opens and closes the air bleed means to control the quantity of air bled into the high speed and low speed fuel circuits. The solenoid includes isolation means for isolating the high speed air bleed path from the low speed air bleed path to prevent cross flow of air from one air bleed path to the other. Cross flow of air between the paths adversely affects the degree of control over the delivery of fuel through the high speed and low speed fuel circuits. Other objects and features will be in part apparent and in part pointed hereinafter.

BRIEF DESCRIPTION OF THE DRAWINGS

FIG. 1 is a schematic representation of a control system for an internal combustion engine;

FIG. 2 is a side elevational view, in section, of a carburetor illlstrating the improvement of the present invention;

Corresponding reference characters indicate corresponding parts throughout the several views of the drawings.

DESCRIPTION OF A PREFERRED EMBODIMENT

Figure 6:
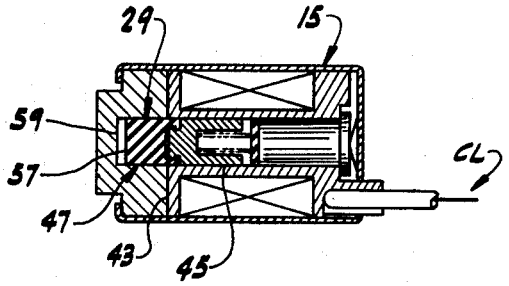
FIG. 6 is a side elevational view, in section, of a second embodiment of the improvement of the present invention.

Referring to the drawings, a control system for an internal combustion engine E is generally indicated 1 in FIG. 1. Engine E has a carburetor C mounted thereon and control system 1 is designed to control to the air-to-fuel ratio of the mixture produced in the carburetor and combusted in the engine. For this purpose, the control system includes a oxygen sensor S located in an exhaust system ES of the engine. Sensor S senses the oxygen content in the engine exhaust and generates an electrical signal representative of this content. The signal is supplied to an electronic control unit ECU which processes the signal and generates a control signal supplied over a line CL to an electromechanical control device EMD. The net result obtained with control system 1 is better management, the air-fuel ratio and the reduction of engine emissions.

Referring to FIG. 2, carburetor C is shown to have an air passage AP with a choke valve CV at its inlet, a throttle valve TV near its outlet and a stacked venture section generally indicated V intermediate the length of the air passage. A fuel bowl FB serves as a reservoir of fuel supplied to air passage AP through either of two fuel circuits. The first of these is a high speed fuel circuit indicated generally HS. Fuel is delivered through this circuit when engine E is operating at an rpm level somewhat higher than its idle level. The second of the fuel circuits is a low speed fuel circuit generally indicated LS. Fuel is delivered through the circuit when engine E is at idle or no load conditions. Operation of both the high and low speed circuits to deliver fuel from fuel bowl FB to air passage AP is well known in the carburetor art and will not be described in detail.

Figure 4:
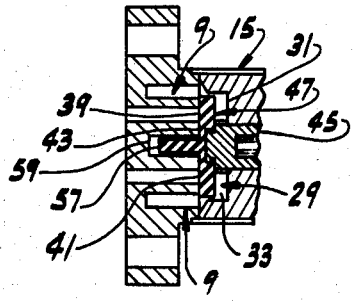
FIG. 4 is a side elevational view in section of a portion of a solenoid further illustrating the improvement of the present invention.

The improvement of the present invention comprises an air bleed means 3 defining a high speed air bleed path 5 for bleeding auxiliary air drawn into carburetor C to high speed fuel circuit HS and a low speed air bleed path 7 for bleeding air to low speed fuel circuit LS. Means 3 includes an auxiliary air intake passage 9 whose inlet is adjacent the inlet of air passage AP. Passage 9 has a vertical section 11 leading to a horizontal section 13. Air flowing through passage 9 enters a solenoid unit 15 whose construction and operation is described hereinafter. From solenoid unit 15, air bleed path 5 includes a horizontal section 17 and a downwardly section 19 whose outlet opens into the high speed circuit at an anti-percolation well 21. Similarly, air bleed 7 includes a first horizontal section 23, a vertical section 25, and a second horizontal section 27 whose outlet opens into a vertical section of low speed circuit LS at a point somewhat above throttle valve TV. Air introduced into either fuel circuit via its respective air bleed path changes the pressure or vacuum signal to which the fuel circuit is subjected. This, in turn, effects the quantity of fuel drawn through the fuel circuit and thus the air-fuel ratio of the resultant mixture produced in air passage AP. As shown in FIG. 4, two separate intake passages 9 are provided, each separate passage forming a portion of air bleed path 5 or air bleed path 7. Solenoid 15 is responsive to the control signal appled to live CL to open and close air bleed paths 5 and 7 and thus control the quantity of air bleed into the high speed and low speed fuel circuits. Unlike previous control systems, only one solenoid 15 is used with carburetor C to control flow of bleed air to the fuel circuits. Since the bleed paths for both fuel circuits are routed to and from the solenoid, the solenoid includes an isolation means 29 for separating onebleed path from the other.

As shown in FIGS. 2 and 4, air bleed means 3 includes two adjacent air flow chambers, 31 and 33 respectively, defined or formed in the body of solenoid 15. Bleed air flowing through path 5 is directed to chamber 31 while bleed air flowing through path 7 is directed to chamber 33. Each chamber has an inlet, 35 and 37 respectively, and an outlet, 39 and 41 respectively. Outlets 39 and 41 are formed in a common wall 43 and are spatially separated from each other. Outlet 39 forms the inlet to passage 17 of air bleed path 5 while outlet 41 forms the inlet to passage 23 of air bleed path 7.

Figure 3:
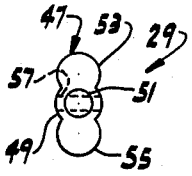
FIG. 3 is a front elevational view of an isolator pad of the present invention.
Figure 5:
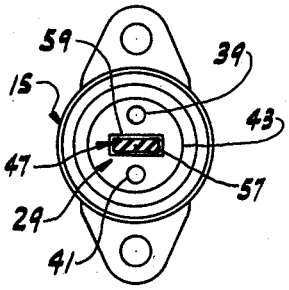
FIG. 5 is a front elevation view of the solenoid of FIG. 4.

Solenoid 15 has a movable armature 45 and isolation means 29 comprises an isolation pad 47 attached to the forward end of the armature for movement therewith. The pad is thus movable relative to the outlets of the flow chambers. As shown in FIG. 3, pad 47 has central circular section 49 in which is formed a circular cavity 51 sized to accomodate the end of armature 45 so the pad may be attached to the armature. The pad further has two opposed sealing pads, 53 and 55, respectively. The sealing pads are also circular in shape and their diameter such that when armature 41 is at its forwardmost position, as shown in FIG. 4, the sealing pads completely block outlets 39 and 41 so no bleed air enters respective passages 17 and 23 of air bleed paths 5 and 7.

An arm 57 projects forwardly from the front face of pad section 49. A cavity 59 is formed in wall 43 between outlets 39 and 41 and arm 57 extends or is received in this cavity. As shown in the drawings, the length of arm 57 is such that it is maintained in cavity 59 even when armature 45 is at its further retracted positon. Referring to FIG. 6, arm 57 extends completely across cavity 59.

As a consequence of the above arm 57 acts as an isolation wall completely separating flow chamber 31 from flow chamber 33. Thus, bleed air entering one of the chambers cannot be drawn to the other chamber and effect the resultant pressure signal change produced on the appropriate fuel circuit by the air flowing through its associated air bleed path. At the same time, the solenoid is effective to control bleed air drawn into both bleed paths and thus provide the desired control over air-fuel mixture which control system is designed to effect.

Figure 7:
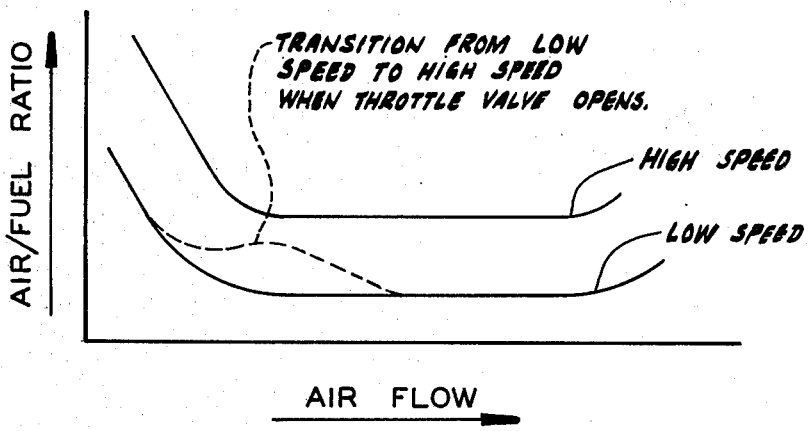
FIG. 7 is a graph of air/fuel ratio versus air flow used for understanding the operation of a control system with the improvement of the present invention.

Referring to FIG. 7, the curves shown in the graph represent the total fuel flow through carburetor C. The dotted line shown on the lower graph indicates what happens if there is no isolation between the air bleed circuits. As throttle valve TV opens, there is a transition range during which fuel delivery from fuel bowl FB to air passage AP changes over from low speed fuel circuit LS to high speed fuel circuit HS. Because the pressure signal on the low speed circuit is greater than that on the high speed circuit, bleed air flowing in air bleed path 5 would be drawn off to air bleed path 7. As a result, neither fuel circuit would be subjected to the amount of correction determined by the electronic circuitry processing the signal from sensor S, and the air-fuel ratio in the idle speed circuit would be richer than intended. This is indicated by the upward bulge in the lower curve (the dashed line). By completely isolating the two bleed paths as isolation means 29 of the present invention does, the above described condition cannot occur. As a result, the proper of amount of correction is achieved in both fuel circuits throughout the range of air flow conditions. Thus, the capability needed to control air-fuel ratio is obtained with only one solenoid 15 instead of two solenoids as were used in the past. This provides cost savings, and greatly simplifies the system needed to achieve the proper control.

In view of the above, it will be seen that the several objects of the invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. In a control system for an internal combustion engine, the engine having a carburetor mounted thereon for producing an air-fuel mixture combusted in the engine, the carburetor having at least one air passage therethrough, a source of fuel, and high and low speed fuel circuits by which fuel is delivered from the source to the air passage to mix with air to form the mixture combusted, the system including a sensor for sensing a component of the products of combustion and for producing an electrical signal representative thereof, an electronic circuitry for processing the electrical signal to produce a control signal for controllng the air-fuel ratio of the mixture produced in the carburetor, the improvement comprising air bleed means defining a high speed air bleed path and a low speed air bleed path for respectively bleeding air into the high speed and low speed fuel circuits to vary the quantity of fuel delivered to the air passage through either fuel circuit at any one time, the air bleed means including means defining two adjacent air flow chambers in the solenoid, each chamber having an inlet and an outlet so air passing through one of said chambers is directed to the high speed fuel circuit while air passing through the other of said chambers is directed to the low speed fuel circuit; a solenoid having a movable armature and responsive to the control signal for opening and closing the air bleed means to control the quantity of air bled into the high speed and low speed fuel circuits; and, isolation means for isolating the high speed air bleed path from the low speed air bleed path to prevent cross flow of air between the paths which adversely affects the degree of control over fuel delivery through the high and low speed fuel circuits, the isolating means comprising an isolation pad attached to one end of the armature and separating the two chambers so air entering one of the chambers cannot flow into the other chamber, the outlets of each chamber being in a common wall spatially separated from each other, the wall having a cavity formed therein between the outlets and extending the length of the chambers, and the isolation pad being sufficiently large to simultaneously close both outlets when no signal is supplied to the solenoid and having an extending arm projecting into the cavity to create an isolation wall between the chambers, the depth of the cavity and the length of the arm being such that the arm remains in the cavity even when the pad is drawn away from the outlets when a signal is supplied to the solenoid whereby a physical barrier is maintained at all times between the chambers to isolate the high and low speed air bleed paths from each other.

2. The improvement of claim 1 wherein the isolation pad includes two sealing pads each of which closes one of the respective chamber outlets.

* * * * *